US007059377B2

(12) United States Patent
Nien et al.

(10) Patent No.: US 7,059,377 B2
(45) Date of Patent: Jun. 13, 2006

(54) DOUBLE-LAYER ROLLER BLIND

(75) Inventors: Ming Nien, Changhua Hsien (TW); David Kuei-Tin Pon, Irvine, CA (US)

(73) Assignee: Nien Made Enterprise Co., Ltd., Taichung (TW)

( * ) Notice: Subject to any disclaimer, the term of this patent is extended or adjusted under 35 U.S.C. 154(b) by 4 days.

(21) Appl. No.: 10/896,936

(22) Filed: Jul. 23, 2004

(65) Prior Publication Data

US 2005/0087309 A1 Apr. 28, 2005

(30) Foreign Application Priority Data

Oct. 24, 2003 (CN) ..... 2003 2 01009778

(51) Int. Cl.
*E06B 9/08* (2006.01)

(52) U.S. Cl. ..... 160/120

(58) Field of Classification Search ..... 160/120, 160/121.1, 122, 241, 266, 267.1
See application file for complete search history.

(56) References Cited

U.S. PATENT DOCUMENTS

| | | | | | |
|---|---|---|---|---|---|
| 1,046,862 | A | * | 12/1912 | Sands | 160/120 |
| 1,303,081 | A | * | 5/1919 | Losee | 160/29 |
| 1,713,452 | A | * | 5/1929 | Schiff | 160/120 |
| 2,702,081 | A | * | 2/1955 | North et al. | 160/120 |
| 3,980,122 | A | * | 9/1976 | Takazawa | 160/85 |
| 4,151,871 | A | * | 5/1979 | Ryan | 160/25 |
| 4,433,711 | A | * | 2/1984 | Lew | 160/120 |
| 5,524,693 | A | * | 6/1996 | Hamilton | 160/243 |

* cited by examiner

*Primary Examiner*—David Purol
(74) *Attorney, Agent, or Firm*—Birch, Stewart, Kolasch & Birch, LLP

(57) ABSTRACT

A double-layer roller blind includes a first roller and a second roller horizontally arranged in parallel at the top side of a window, a first shade fastened with a top edge thereof to the first roller, a first bottom bar fastened to a bottom edge of the first shade, a second shade fastened with a top edge thereof to the second roller, and a second bottom bar fastened to a bottom edge of the second shade and suspended below the first bottom bar. The first bottom bar is provided with an insertion space through which the second shade is inserted such that the second shade is kept close to the first shade.

8 Claims, 6 Drawing Sheets

DOUBLE-LAYER ROLLER BLIND

This Nonprovisional application claims priority under 35 U.S.C. § 119(a) on Patent Application No. 2003201009778 filed in China on Oct. 24, 2003, the entire contents of which are hereby incorporated by reference.

BACKGROUND OF THE INVENTION

1. Field of the Invention

The present invention relates to a roller blind and more particularly, to a double-layer roller blind having two shades that are smoothly close to each other.

2. Description of the Related Art

As shown in FIG. 6, a conventional double-layer roller blind 80 is shown comprised of two rollers 81, 82, two shades 83, 84, and two bottom bars 85, 86. The rollers 81, 82 are transversely pivotally fastened to the top side of the window (not shown), and can be respectively rotated by way of a respective lift cord or a motor governed by a remote controller. The shades 83, 84 have the respective top edge respectively fastened to the rollers 81, 82 such that the rollers 81, 82 can be rotated to roll up or let off the shades 83, 84. The shades 83, 84 are usually made of different fabrics, i.e., the shade 83 which approaches the window has a high transmission rate of light (for example, made of a gauze cloth), the shade 84 which is relatively closer to the inside of the house has a low transmission rate of light. The bottom bars 85, 86 are respectively fastened to the bottom edges of the shades 83, 84, holding the shades 83, 84 smoothly suspended below the rollers 81, 82. The user of the double-layer roller blind 80 can control the rollers 81, 82 to roll up and let off the shades 83, 84 respectively, so as to further regulate the light.

The aforesaid conventional design of double-layer roller blind 80 is still not satisfactory in function. Because of a big gap between the shades 83, 84, the shades 83, 84 tend to be forced apart by wind as the imaginary line indicated in FIG. 6, resulting in unstable amount of incident light.

Therefore, it is desirable to provide a double-layer roller blind that eliminates the aforesaid drawback.

SUMMARY OF THE INVENTION

It is the primary objective of the present invention to provide a double-layer roller blind having two shades, which keeps the front and rear shades smoothly close to each other, giving a nice looking and high stability of light shading.

To achieve this objective of the present invention, the roller blind provided by the present invention comprises a first roller, a second roller, a first shade having a top edge fastened to the first roller, a second shade having a top edge fastened to the second roller, a first bottom bar fastened to a bottom edge of the first shade, and a second bottom bar fastened to a bottom edge of the second shade and suspended below the first bottom bar. The first bottom bar is provided with an insertion space through which the second shade is inserted.

In an embodiment, the first bottom bar has a narrow elongated slot cutting through top and bottom sides thereof to form the insertion space.

In another embodiment, the first bottom bar further comprises at least two guide wheels in contact with two sides of the second shade.

In still another embodiment, the first bottom bar is constructed to include a bar body and two end caps that are respectively fastened to two distal ends of the bar body. The end caps each have an L-shaped flange defining with a periphery of the bar body the insertion space.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
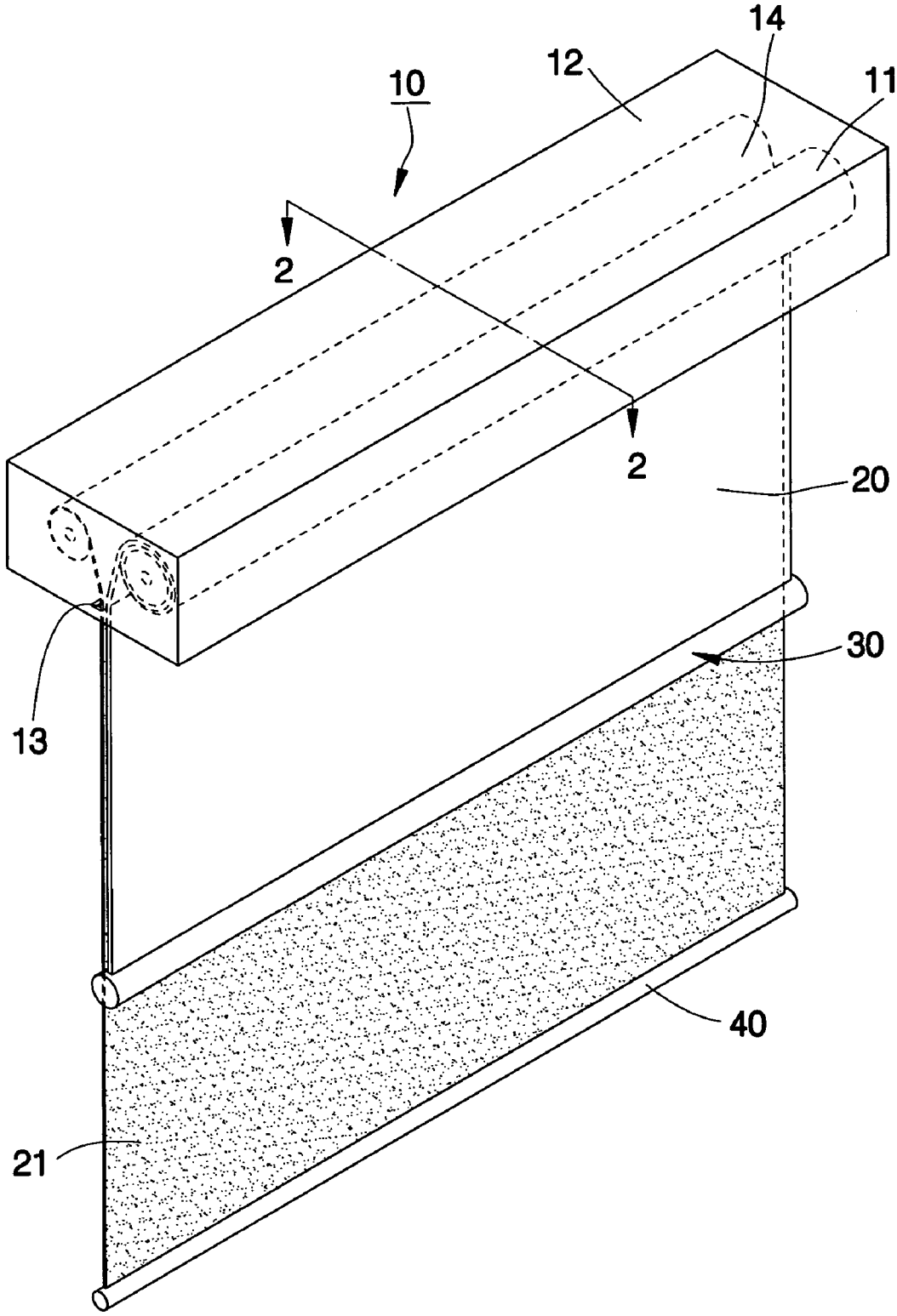
FIG. 1 is a perspective view of a double-layer roller blind according to a first preferred embodiment of the present invention.
Figure 2:
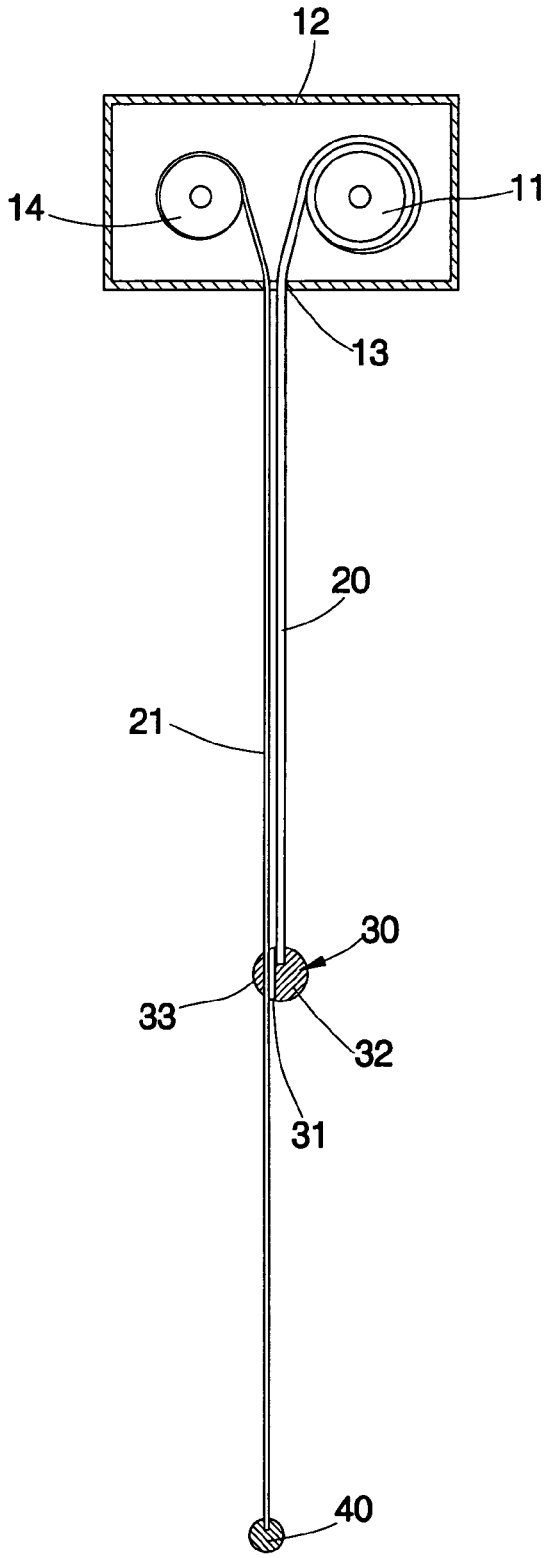
FIG. 2 is a sectional view taken along line 2—2 of FIG. 1.

Referring to FIGS. 1 and 2, a double-layer roller blind 10 in accordance with the first preferred embodiment of the present invention is shown comprised of a first roller 11, a second roller 14, a first shade 20, a second shade 21, a first bottom bar 30, and a second bottom bar 40.

The first roller 11 is a cylindrical member transversely pivotally fastened to the top side of the window (not shown). According to this embodiment, the first roller 11 is fastened pivotally with the inside of an elongated box 12, which is fixedly provided at the top side of the window. The first roller 11 can be controlled to rotate on its own axis inside the elongated box 12. It is to be understood that the method of controlling the first roller to rotate can be achieved by means of any of a variety of conventional techniques, for example, by means of the control of a lift cord, a spring winding mechanism, or a wired or wireless controller. The elongated box 12 has a narrow elongated slot 13 extended along the length in the bottom side on the middle. The first roller 11 is suspended above the narrow elongated slot 13 near one lateral side of the box 12, i.e. the side relatively closer to the inside of the house.

The second roller 14 is a cylindrical member fastened pivotally with the inside of the elongated box 12, and can be rotated on its own axis by the user. According to this embodiment, the second roller 14 is suspended above the narrow elongated slot 13 near the other lateral side of the box 12, i.e. the side relatively closer to the window, and arranged in parallel to the first roller 11 at the same elevation. The two rollers 11, 14 can be controlled by a controller (not shown) to rotate synchronously or independently.

The first shade 20 is made of a sheet material having a relatively lower transmission rate of light. The top edge of the first shade 20 is fixedly fastened to the periphery of the first roller 11. The bottom edge of the first shade 20 is inserted through the narrow elongated slot 13 and suspended below the first roller 11. Therefore, the first roller 11 can be rotated to roll up the first shade 20 or to let off the first shade 20.

The second shade 21 is made of a sheet material having a relatively higher transmission rate of light (for example, gauze cloth). The e top edge of the second shade 21 is fixedly fastened to the periphery of the second roller 14. The bottom edge of the second shade 21 is inserted through the narrow elongated slot 13 and suspended below the second roller 14. Therefore, the second roller 14 can be rotated to roll up the second shade 21 or to let off the second shade 21.

The first bottom bar 30 is a round rod member having an insertion space, which is a narrow elongated slot 31 extended along the length and cut through the top and bottom sides in this embodiment. The narrow elongated slot 31 divides the first bottom bar 30 into a base portion 32 and a retaining portion 33. The retaining portion 33 is formed in the rear side of the first bottom bar 30 approaching the window. The base portion 32 is formed in the front side of the first bottom bar 30 and facing the inside of the house. The top side of the base portion 32 is fixedly fastened to the bottom edge of the first shade 20. The bottom edge of the second shade 21 is vertically downwardly inserted through the narrow elongated slot 31 of the first bottom bar 30, and suspended blow the first bottom bar 30. By means of the effect of the retaining portion 33, the second shade 21 is kept in close proximity to the first shade 20.

The second bottom bar 40 is fixedly fastened to the bottom edge of the second shade 21 below the first bottom bar 30.

When in use, the user can rotate the second roller 14 to lower the second shade 21 to the desired elevation. If the light intensity of incident light is still strong after the second shade 21 has been completely extended out, the user can then rotate the first roller 11 to lower the first shade 20 to the desired elevation, achieving the desired light shading effect.

By means of the design of the base portion 32 and retaining portion 33 of the first bottom bar 30, the first shade 20 and the second shade 21 are maintained in close proximity to each other and will not be forced apart upon a strong wind. Because the first shade 20 and the second shade 21 are constantly maintained in close proximity to each other, the sense of beauty of the double-layer roller blind is maintained. It is to be understood that the first roller 11 and the second roller 14 may be arranged in parallel at different elevations or constructed to roll up the respective shades 20, 21 in reversed directions, keeping the shades 20, 21 suspended below the narrow elongated slot 13 of the elongated box 12.

Further, according to the aforesaid embodiment, the second bottom bar 40 is maintained below the elevation of the first bottom bar 30, i.e., the height of the second shade 21 is maintained below the first shade 20. This arrangement does not affect normal functioning of the double-layer roller blind 10 because lowering the first shade 20 is for the purpose of shading the light that passes through the second shade 21 and because the elevation difference between the first bottom bar 30 and the second bottom bar 40 is insignificant after the first shade 20 and the second shade 21 have been fully extended out. Further, the transmission rate of light between the two shades may be reversed, i.e., the first shade 20 can be made of a sheet material having a relatively higher transmission rate of light, and the second shade 21 can be made of a sheet material having a relatively lower transmission rate of light.

Figure 3:
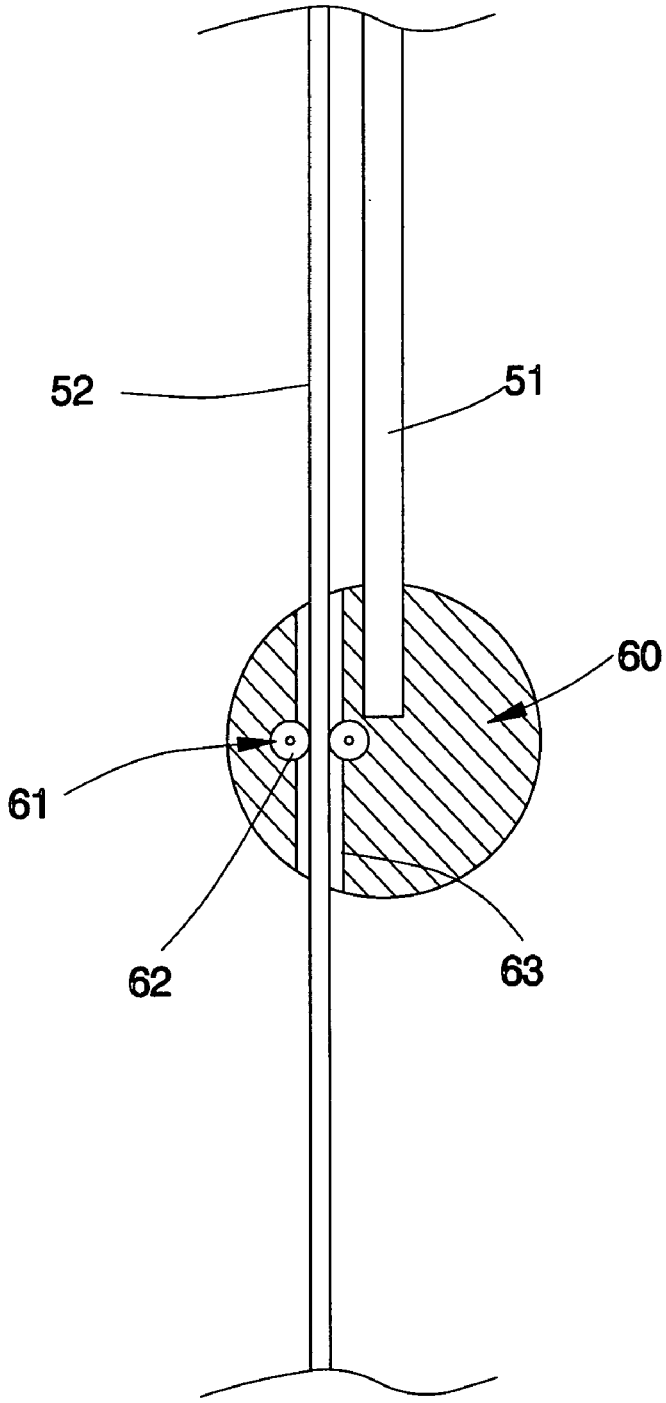
FIG. 3 is a partial view in section of a double-layer roller blind according to a second preferred embodiment of the present invention, showing the structure of the first bottom bar.

According to the second preferred embodiment of the present invention as shown in FIG. 3, the double-layer roller blind 50 is comprised of a first roller (not shown), a second roller (not shown), a first shade 51, which has the top edge fixedly fastened to the periphery of the first roller, a second shade 52, which has the top edge fixedly fastened to the periphery of the second roller, a first bottom bar 60 fixedly fastened to the bottom edge of the first shade 51, and a second bottom bar (not shown) fixedly fastened to the bottom edge of the second shade 52. The second shade 52 is vertically downwardly inserted through an insertion space, i.e. a narrow elongated slot 63, in the first bottom bar 60. Further, two guide wheel sets 61 are provided in the narrow elongated slot 63 inside the first bottom bar 60 near two distal ends. Each guide wheel set 61 is comprised of two guide wheels 62 arranged in parallel at the same elevation. The second shade 52 passes between the two guide wheels 62 of each guide wheel set 61 with two sides thereof in contact with the two guide wheels 62 respectively.

During vertical movement of the first shade 51 or second shade 52, the guide wheel sets 61 reduce friction force between the first bottom bar 60 and the second shade 52.

Figure 4:
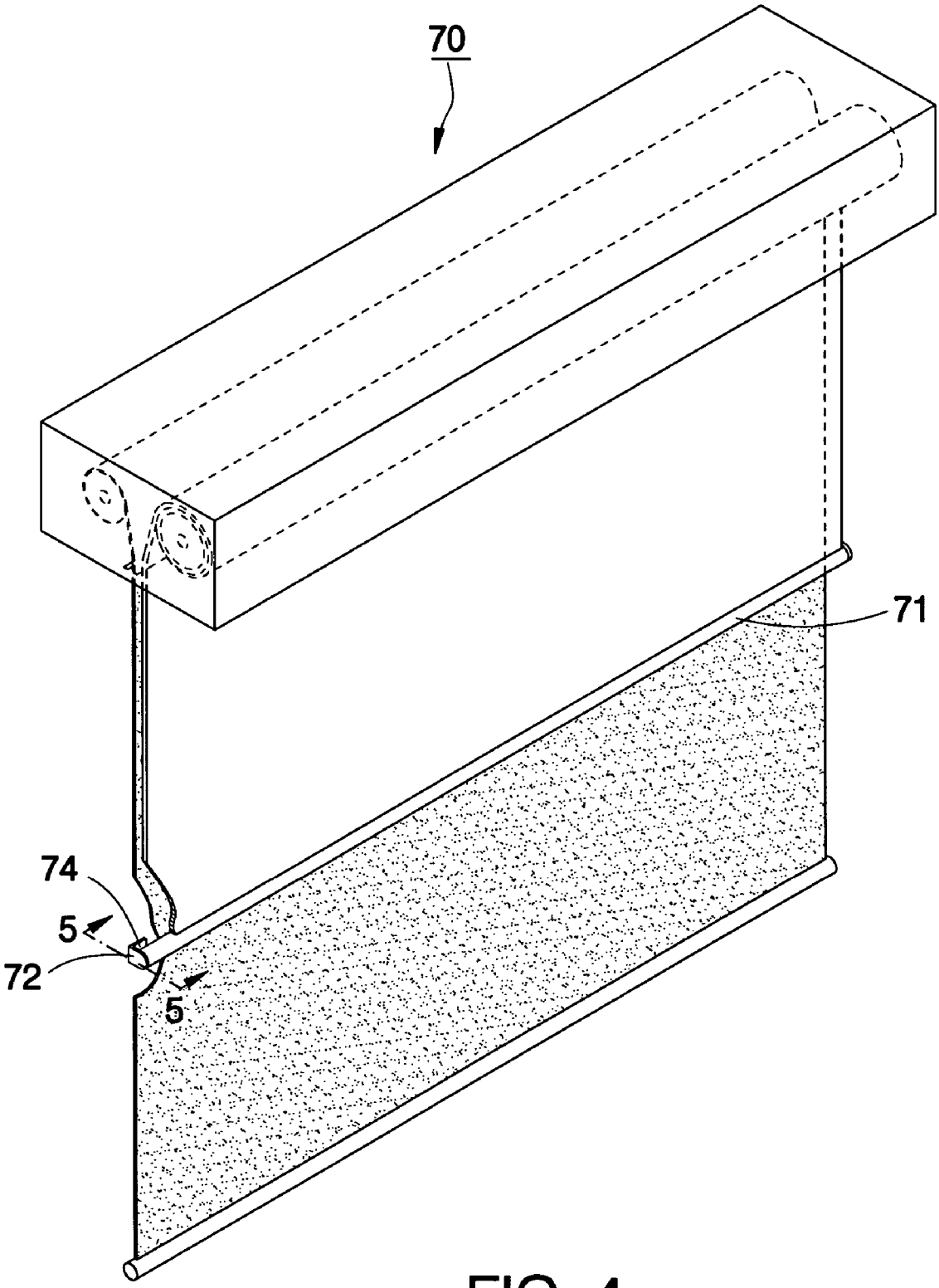
FIG. 4 is a perspective view of a double-layer roller blind according to a third preferred embodiment of the present invention.
Figure 5:
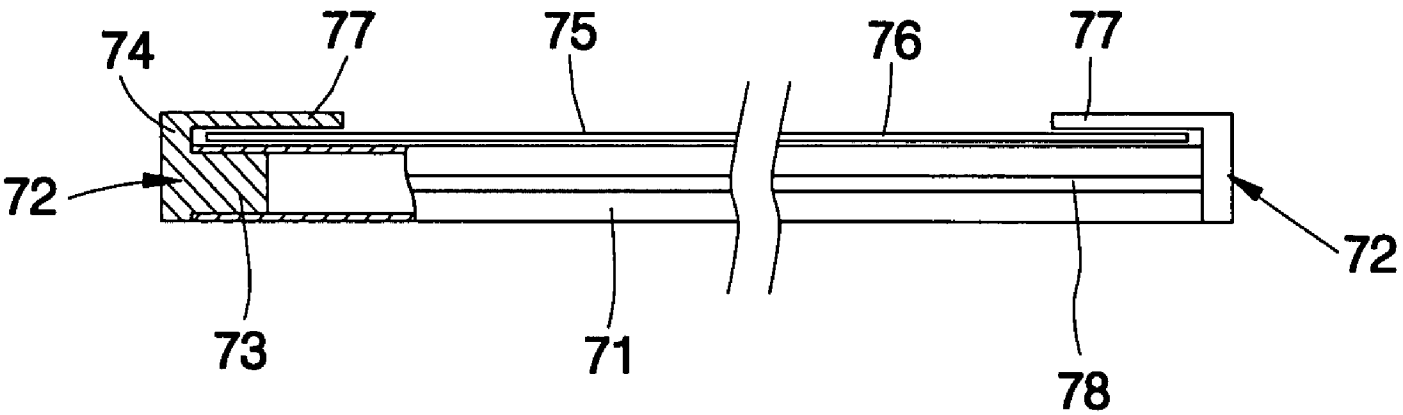
FIG. 5 is a sectional view in an enlarged scale of a part of FIG. 4, showing the structure of the first bottom bar.
Figure 6:
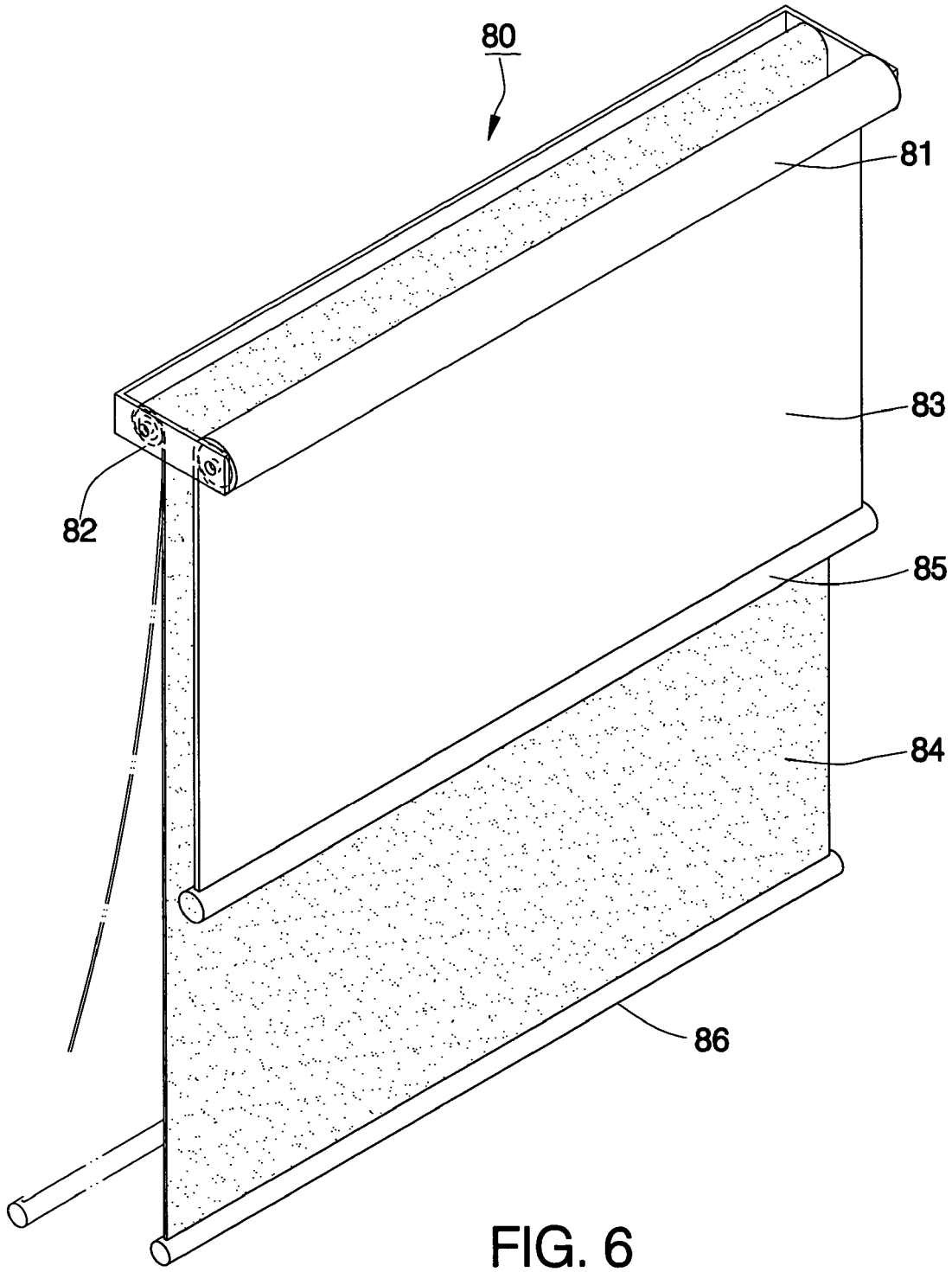
FIG. 6 is a schematic drawing of a double-layer roller blind according to the prior art.

The first and second shades can be maintained in close proximity to each other by another method. According to the third preferred embodiment of the present invention as shown in FIGS. 4 and 5, the first bottom bar of the double-layer roller blind 70 has a bar body 71 and two end caps 72 respectively capped at two distal ends of the bar body 71. Each end cap 72 comprises a plug portion 73, which is inserted into one end of the bar body 71 of the first bottom bar, and a substantially L-shaped flange 74, which extends from the plug portion 73. The L-shaped flanges 74 of the two end caps 72 define with the periphery of the bar body 71 an insertion space 75, which guides movement of the second shade 76 relative to the first bottom bar and keeps the second shade 76 in close proximity to the first shade 78. The L-shaped flanges 74 of the two end caps 72 each have a retaining portion 77, which is disposed in contact with one side of the second shade 76 opposite to the first shade 78.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A roller blind comprising:

a first roller;

a second roller;

a first shade having a top edge fastened to said first roller, and a bottom edge;

a second shade having a top edge fastened to said second roller, and a bottom edge;

a first bottom bar fastened to the bottom edge of said first shade, said first bottom bar having an insertion space through which the second shade is inserted; and a second bottom bar fastened to the bottom edge of said second shade and suspended below said first bottom bar, wherein said first bottom bar comprises a narrow elongated slot cutting through top and bottom sides thereof to form said insertion space.

2. A roller blind comprising:

a first roller;

a second roller;

a first shade having a top edge fastened to said first roller, and a bottom edge;

a second shade having a top edge fastened to said second roller, and a bottom edge;

a first bottom bar fastened to the bottom edge of said first shade, said first bottom bar having an insertion space through which the second shade is inserted; and a second bottom bar fastened to the bottom edge of said second shade and suspended below said first bottom bar, wherein said first bottom bar comprises a base portion fastened to the bottom edge of said first shade, a narrow elongated slot cutting through top and bottom sides thereof to form said insertion space, and a retaining portion spaced from said base portion by said narrow elongated slot and disposed in contact with one side of said second shade opposite to said first shade; wherein said narrow elongated slot is formed in said first bottom bar in an offset position between said base portion and said retaining portion.

3. A roller blind comprising;

a first roller;

a second roller;

a first shade having a top edge fastened to said first roller, and a bottom edge;

a second shade having a top edge fastened to said second roller, and a bottom edge;

a first bottom bar fastened to the bottom edge of said first shade, said first bottom bar having an insertion space through which the second shade is inserted; and a second bottom bar fastened to the bottom edge of said second shade and suspended below said first bottom bar, wherein said first bottom bar comprises a narrow elongated insertion slot cutting through top and bottom sides thereof to form said insertion space, and two guide wheel sets located in said narrow elongated slot near two distal ends, said guide wheel sets each comprising at least two guide wheels disposed in contact with two sides of said second shade.

4. A roller blind comprising:

a first roller;

a second roller;

a first shade having a top edge fastened to said first roller, and a bottom edge;

a second shade having a top edge fastened to said second roller, and a bottom edge;

a first bottom bar fastened to the bottom edge of said first shade, said first bottom bar having an insertion space through which the second shade is inserted; and a second bottom bar fastened to the bottom edge of said second shade and suspended below said first bottom bar, wherein said first bottom bar comprises a bar body and two end caps respectively fastened to two distal ends of said bar body, said end caps each having an L-shaped flange, the L-shaped flanges of said two end caps defining with a periphery of said bar body said insertion space.

5. The roller blind as claimed in claim 1, wherein said first shade and said second shade are respectively made of materials having different light transmission rates.

6. The roller blind as claimed in claim 2, wherein said first shade and said second shade are respectively made of materials having different light transmission rates.

7. The roller blind as claimed in claim 3, wherein said first shade and said second shade are respectively made of materials having different light transmission rates.

8. The roller blind as claimed in claim 4, wherein said first shade and said second shade are respectively made of materials having different light transmission rates.

* * * * *